United States Patent [19]

Hannon

[11] Patent Number: 4,955,594

[45] Date of Patent: Sep. 11, 1990

[54] DROP FEED METERING HOPPER FOR MULTIPLE SECTION NEWSPAPERS AND THE LIKE

[75] Inventor: Charles N. Hannon, Olathe, Kans.

[73] Assignee: Stepper, Inc., Olathe, Kans.

[21] Appl. No.: 203,332

[22] Filed: Jun. 7, 1988

[51] Int. Cl.[5] ..... B65H 39/02

[52] U.S. Cl. ..... 270/58; 270/52; 270/54

[58] Field of Search ..... 270/52, 54, 55, 56, 270/57, 58; 271/278, 279, 8.1, 264

[56] References Cited

U.S. PATENT DOCUMENTS

| | | | |
|---|---|---|---|
| 3,519,264 | 7/1970 | Beacham | 270/54 |
| 3,809,385 | 5/1974 | Rana | 270/54 |
| 4,177,979 | 12/1979 | Orsinger | 270/54 |
| 4,471,953 | 9/1984 | Reist | 270/54 |
| 4,576,370 | 3/1986 | Jackson | 270/54 |

FOREIGN PATENT DOCUMENTS

| | | | |
|---|---|---|---|
| 496574 | 11/1970 | Switzerland | 270/54 |

*Primary Examiner*—Edward K. Look
*Assistant Examiner*—Therese M. Newholm
*Attorney, Agent, or Firm*—Hovey, Williams, Timmons & Collins

[57] ABSTRACT

An upright hopper has a pair of bottom doors which support one or more newspaper sections in flat, horizontal orientation. The doors shift in opposite directions toward an open position in timed relationship to movement of a conveyor passing beneath the doors to drop the sections onto defined bucket areas of the conveyor. One or more hoppers, associated with a single, horizontally moving conveyor, can be utilized by one or more operators to meter toward downstream processing equipment newspaper editions which have been completely assembled before reception in the hopper. Alternatively, the hoppers may be used for newspaper assembly or collation, wherein each operator contributes respective sections to corresponding hoppers which open at the proper time to assemble the complete edition. A number of sensing devices are provided to ensure reliable, automatic operation with minimal attention.

24 Claims, 4 Drawing Sheets

DROP FEED METERING HOPPER FOR MULTIPLE SECTION NEWSPAPERS AND THE LIKE

BACKGROUND OF THE INVENTION

1. Field of the invention

The present invention relates generally to the field of newspaper handling equipment and, more particularly, to method and apparatus used in bringing together or collating the various sections that comprise a typical modern-day, multi-section newspaper.

2. Description of the prior art

Today's bulky, multiple-section, large-city newspapers are extremely difficult to handle with automated equipment. A complete edition may sometimes weigh several pounds; yet it is floppy, easily torn and tends to become easily disassembled during handling and distribution. Moreover, it is becoming increasingly popular to provide these papers with a mass of slick advertising inserts and other materials that are difficult to handle in their own right and are hard to contain within the paper, further contributing to an already troublesome situation.

Larger newspapers, particularly Sunday editions, typically comprise several different groups of mutually nested sections which are often stacked on top of one another in superimposed relationship to form a complete, bulky newspaper. Sometimes, the different groups of nested sections may be contained within a final, outer "jacket" or "wrapper" which is formed by the "front page" section of the newspaper. It is the Sunday editions that most frequently contain the loose collection of advertising slicks and other inserts.

Most large newspaper printing presses have the capability of assembling sections and nesting them within one another up to a limited number of pages. However, from that point on, these different groups of nested sections must then be combined or collated with other nested groups of sections to make a complete newspaper edition. This is typically accomplished using a battery of several different automatic hoppers which are spaced along a common conveyor line to dispense different groups of the nested sections onto the conveyor in timed relationship with one another. Each of the hoppers successively dispenses the entire supply of one of the groups of nested sections onto the conveyor, and on top of other groups of sections coming down the line, so that by the time the end of the line is reached, the newspaper will be fully assembled, or nearly so. Each hopper holds several, identical groups of nested sections at a time and operates continuously to feed its successive groups of papers at regular intervals, corresponding exactly to the feed rate of the other hoppers. The hoppers must be continuously replenished with more groups of newspaper sections, either manually or through the provision of automatic loaders.

Automatic hoppers of this type are disclosed and claimed, for example, in my prior U.S. Pat. Nos. 3,777,907, 4,557,472 and 4,702,467, assigned to the assignee of the present invention. These hoppers have proven to be remarkably successful in coping with the inherent problems and frustrations of feeding bulky newspapers. Yet, there are times when even these hoppers have proven to be less than ideal.

For example, while my prior hoppers are each capable of operating at relatively high speeds and of handling a variety of different thicknesses of groups of the newspaper sections, there are still times when a misfeed can occur, causing the hopper to shut down. If only one hopper were operating, it would not be a particularly serious or difficult situation to deal with, since the misfeed could usually be cleared without too much difficulty and the hopper returned to service.

However, where a large number of the hoppers are teamed together to assemble a large newspaper in the manner described above, a misfeed in one of the hoppers has the effect of shutting down the entire system until the misfeed is cleared. This has a very serious impact on the total throughput of the system, i.e., the rate of finished newspapers coming off the end of the line can be very seriously affected. Thus, the percentage of time that the assembly line is idle may be relatively high, even though the likelihood of failure of any particular one of the hoppers is somewhat low. A misfeed by any one hopper normally requires instant attention and interruption of the work operation, although the attendants associated with the remaining hoppers may be unoccupied for some time.

In the newspaper printing and distribution business, time is almost always of the essence. Thus, shutdown of an assembly line, for any reason, is a serious matter and is to be avoided if at all possible. Certainly, the idle time during each shutdown must be minimized. While in the printing of Sunday editions, for example, it is the common practice to print some of the feature sections, the comics and advertising inserts several days in advance and to store them at a substation during the middle of the week, on Saturday night and early Sunday morning, those pre-assembled groups of sections must be finally assembled in a very short "window" of time with the main sections of the newspaper which are printed at the very last minute and contain late-breaking news and sports.

Another problem associated with currently available automatic hoppers is that they require some degree of skill in order to run them properly, correct misfeeds, and make adjustments. Typically, full-time, dedicated and skilled employees are not available in large numbers at the distribution substations, nor could they be economically afforded. Rather, part-time, unskilled workers at minimum wage levels are usually the only help available during the last minute rush to assemble large papers such as Sunday editions, many of whom are not particularly familiar with the procedures involved, and certainly not with the sophisticated mechanisms embodied in the automatic hoppers.

Furthermore, the newspaper sections, inserts and groups of sections are oftentimes not in a neat, squared-up configuration that can be readily handled by the automatic hoppers of conventional design. Frequently, they are disheveled and ratty with loose corners and edges projecting outwardly from the sides of the package presented to the machine. The machine itself has no ability to rearrange and straighten out the package, resulting in a sure misfeed or jamming situation. In this same regard, sometimes the sections and inserts presented to the automatic machine have not been properly nested within one another but instead are only piled or stacked up on top of each other. This causes the machine to either shut down because it cannot handle the loose materials, or it feeds the individual sections one at a time instead of in a group as intended, spreading the sections into several different newspaper editions instead of all into one.

Some efforts have been made to accomplish the assembly operations without the use of automatic hoppers at all. With that kind of arrangement, the number of workers are simply positioned along a common conveyor line with each worker manually taking different groups of the nested sections from their respective stacks, placing them on top of one another in a short group or stack, and then placing them on the rapidly moving conveyor. However, it was found using this technique that the workers quickly become mentally and physicially exhausted because careful movements and attentiveness are required in order to coordinate depositing the newspapers on the conveyor with the velocity and timing of the conveyor.

SUMMARY OF THE INVENTION

Accordingly, one important object of the present invention is to provide a newspaper assembly system which is less complicated, more reliable, and easier to operate than previous systems without sacrificing total throughput.

In this regard, the present invention contemplates eliminating the multiplicity of automatic metering hoppers heretofore utilized in favor of a more manual system that does not cause the entire system to shut down when one source of supply of the newspapers being assembled breaks down or becomes incapacitated. In the present invention, one or more "single shot" drop hoppers is used in connection with the conveyor to receive successive groups of nested sections from a worker on a "one group at a time" basis and to dispense each such single group to the conveyor before the worker loads the next group of sections into the hopper. The worker is supplied with several stacks of the different newspaper sections at his workstation and takes one of the sections from each stack and superimposes it upon sections from the other stacks to make a composite group, which he then merely places in the hopper and turns his attention back toward making the next group of sections. In the meantime, the drop hopper senses the deposit of the group of sections by the worker, detects when the next available receiving space on the conveyor has arrived, and then drops the group of papers to the conveyor.

The deposited group moves downstream for further handling which may include, for example, insertion within an outer jacket of the newspaper consisting of the main headlines or the like. If desired, a multiplicity of the single shot drop hoppers may be positioned along the length of the conveyor and supplied with newspapers by a corresponding number of workers, but instead of supplying different sections of the newspaper to the conveyor line and then progressively building the newspaper as it moves down the line, each hopper delivers its own complete collection or group of sections comprising a newspaper to the conveyor line. Therefore, the line may operate continously, even though one or more of the hoppers may become temporarily incapacitated for any reason.

The metering hopper is of a size to receive newspaper sections in flat, horizontal orientation from either a single person stationed on one side of the hopper or alternatively from two persons positioned on alternate sides of the hopper. The hopper releases the stacked sections at the proper time and in coordination with movement of the conveyor for landing on an appropriate, predefined bucket area of the conveyor therebeneath.

More particularly, a gate in the nature of a pair of oppositely movable, shiftable doors extends when in a closed position across a bottom region of the hopper for supporting newspaper sections therein. A sensing device positioned to detect movement of the drive mechanism for the conveyor is coupled to a microcomputer which, in turn, triggers an electric clutch to open the doors at a time when a bucket of the conveyor is disposed directly beneath the hopper. As the doors open away from each other, the sections previously received in the hopper are dropped into the path of the conveyor.

Each fore-and-aft side of the hopper is provided with a ramp area which extends in an inclined direction away from the lower region of the hopper immediately above the doors. Sensors positioned adjacent the ramp area detect movement of the workers' hands therealong after the sections have been placed within the hopper so that the microcomputer can thereby determine that the hopper has been properly loaded. The collating apparatus can be pre-set for one man operation so that tripping of a single sensor is sufficient for enabling the doors to open when the next available bucket area reaches the hopper; alternatively, the apparatus can be pre-set for two-man operation wherein hands of both individuals must pass by respective sensors of each ramp area so that the computer can thereby infer that the proper number of sections are supported on the doors before the doors are opened in timed, coordinated relation with the approach of the next bucket area.

In addition, a number of other sensors are utilized to provide substantially automatic, trouble-free operation. One sensor is arranged to prevent opening of the doors when the hopper is empty. Two other sensors are located in an upper portion of the hopper and prevent opening of the doors whenever sections of the newspaper have become caught on the hopper and might otherwise fail to properly drop onto the conveyor. Also, a sensor positioned above the conveyor downstream of one hopper is coupled to the microcomputer and detects the presence of newspaper sections in each bucket area for opening another, downstream drop hopper whenever proper bucket conditions are sensed.

Consequently, the present invention substantially increases the efficiency of newspaper collation, since the users need not time their movements in coordination with the movement of a conveyor. Instead, the workers need merely gather the sections and load the same onto the hopper, and the shiftable gate and microcomputer function to properly meter the loaded sections onto selected, pre-defined bucket areas of the conveyor.

Moreover, the system is modular in nature and flexible in operation. For instance, a single operator can use the apparatus to properly meter smaller, assembled newspaper editions of only three or four sections to downstream bagging or inserting equipment. Alternately, two individuals may load a completely assembled edition into a single hopper for reception onto different bucket areas of the conveyor, or likewise four individuals may each load completely assembled editions into two different hoppers while the microcomputer can be set to drop the editions onto separate bucket areas of the conveyor. As another option, the microcomputer can be pre-set for collation to allow two or more persons to load respective, different newspaper sections onto each passing bucket area of the conveyor, a particularly desirable feature for larger Sunday editions comprised of numerous different sections.

The ramps adjacent the hopper provide convenient side access to lower regions of the hopper for facilitating loading of the newspaper sections on the doors. In preferred forms of the invention, the ramps are pivotally mounted for sliding contact with an upper, flat surface of the doors as the doors shift from a closed position and toward an open position to drop the sections onto the conveyor. The ramps function to wipe the doors and ensure that the newspaper sections supported thereon drop through the discharge outlet of the hopper and do not instead shift horizontally together with one of the doors. If desired, the doors may be pivoted toward an upright, out-of-the-way position to enable access to portions of the conveying machinery therebelow.

DETAILED DESCRIPTION OF THE DRAWINGS

Figure 1:
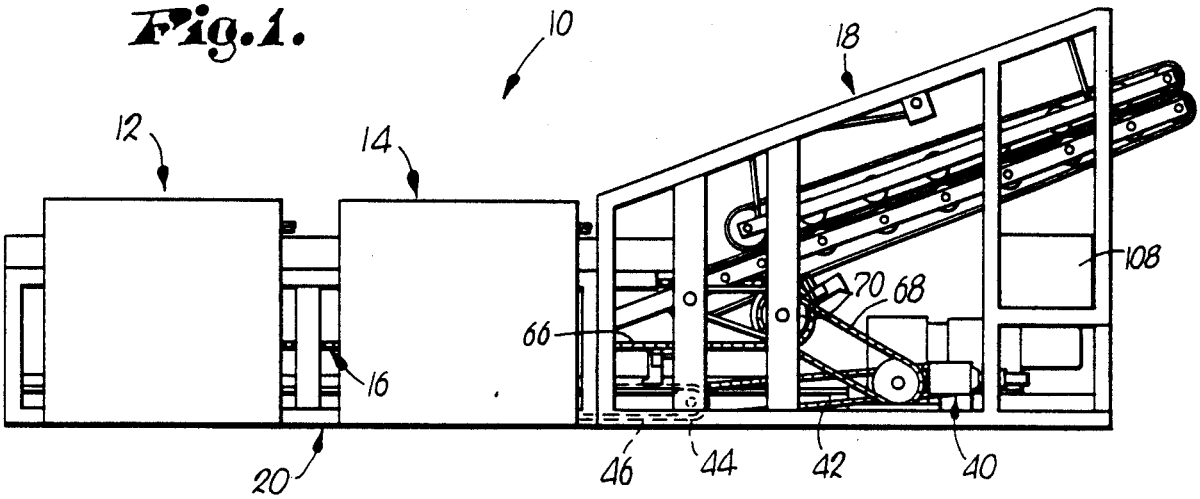
FIG. 1 is a side elevational view of a pair of drop feed metering hoppers constructed in accordance with principles of the present invention and positioned to feed multiple section newspapers to an exit conveyor.

Referring initially to FIG. 1, newspaper section handling apparatus 10 broadly includes a first or upstream drop feed metering hopper 12 and a second or downstream drop feed metering hopper 14. Both of the hoppers 12, 14 are associated with a single horizontal conveyor 16 which delivers the assembled newspaper sections in this instance to an inclined exit conveyor 18. The exit conveyor 18 transports the newspaper sections to downstream processing machinery such as a bagger or an inserter, although it is to be understood in this regard that conveyor 16 may instead deliver the assembled newspapers directly to other equipment without the use of conveyor 18.

Figure 4:
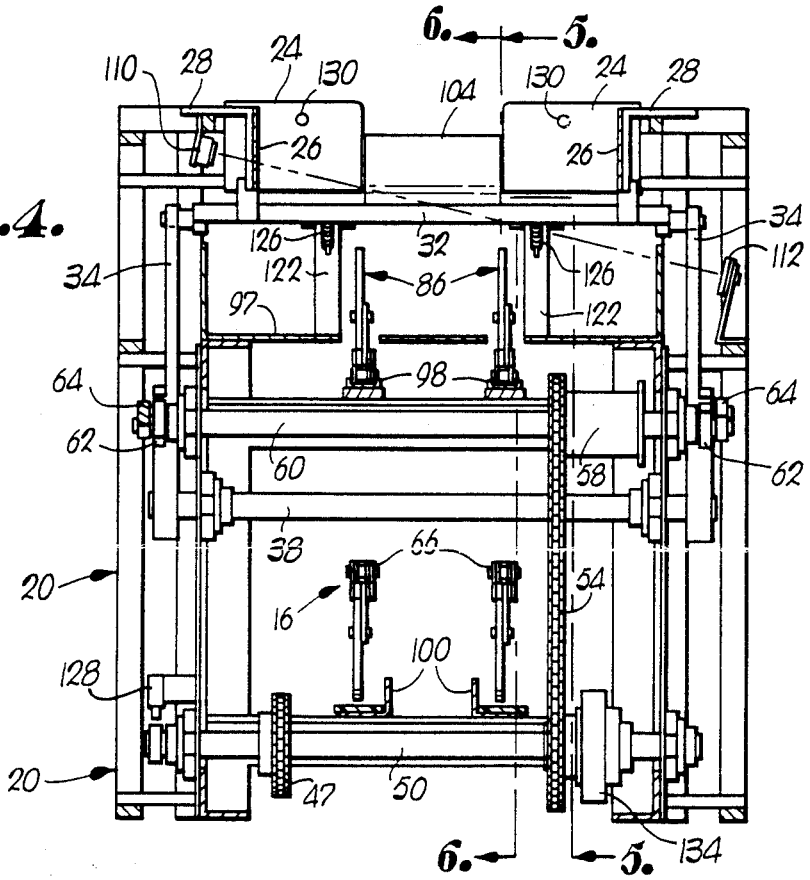
FIG. 4 is an end cross sectional view taken substantially along line 4—4 of FIG. 3, illustrating upper and lower reaches of a conveyor.
Figure 2:
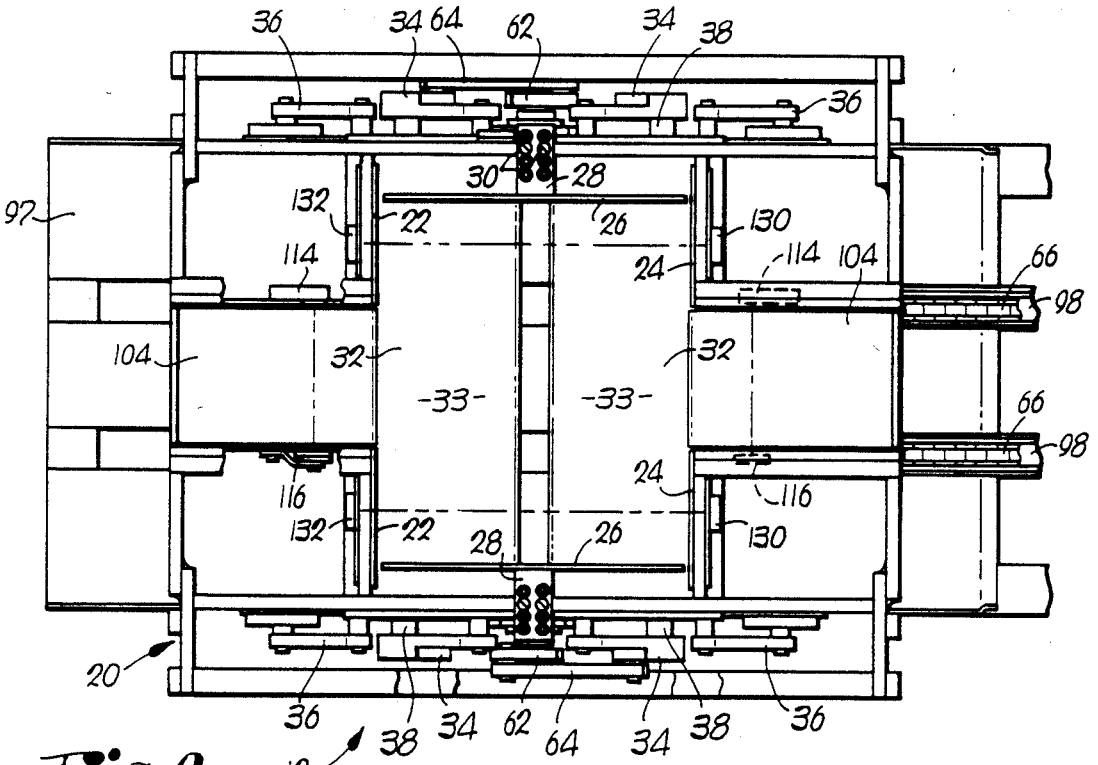
FIG. 2 is an enlarged, fragmentary, plan view of the first or upstream metering hopper illustrated in FIG. 1.

Reference should now be made to FIGS. 2–5 where the first, upstream metering hopper 12 is illustrated in more detail. The hopper 12 is mounted on a frame 20 and includes a pair of vertical, spaced apart front walls 22 (see, e.g., FIG. 2) and a pair of vertical, spaced apart rear walls 24 (FIGS. 2 and 4). Hopper 12 also has a pair of parallel, vertical side walls 26 extending between respective walls 22, 24. Walls 22, 24, 26 together define a rectangular area complemental in configuration to the periphery of folded newspaper sections.

As shown in FIG. 2, each sidewall 26 is fixed to a corresponding bracket 28 having a horizontal leg that is provided with four pairs of holes. Two allen head bolts 30 extend through one pair of the holes to secure the bracket 28 and thereby the corresponding sidewall 26 to the frame 20. As such, the distance between the sidewalls 26 may be varied to accomodate newspapers of different width by removing bolts 30, shifting the sidewall 26 in a lateral direction until a different pair of holes of the bracket 28 is in alignment with holes of the underlying portion of frame 20 and then inserting bolts 30 in the choosen holes.

Figure 3:
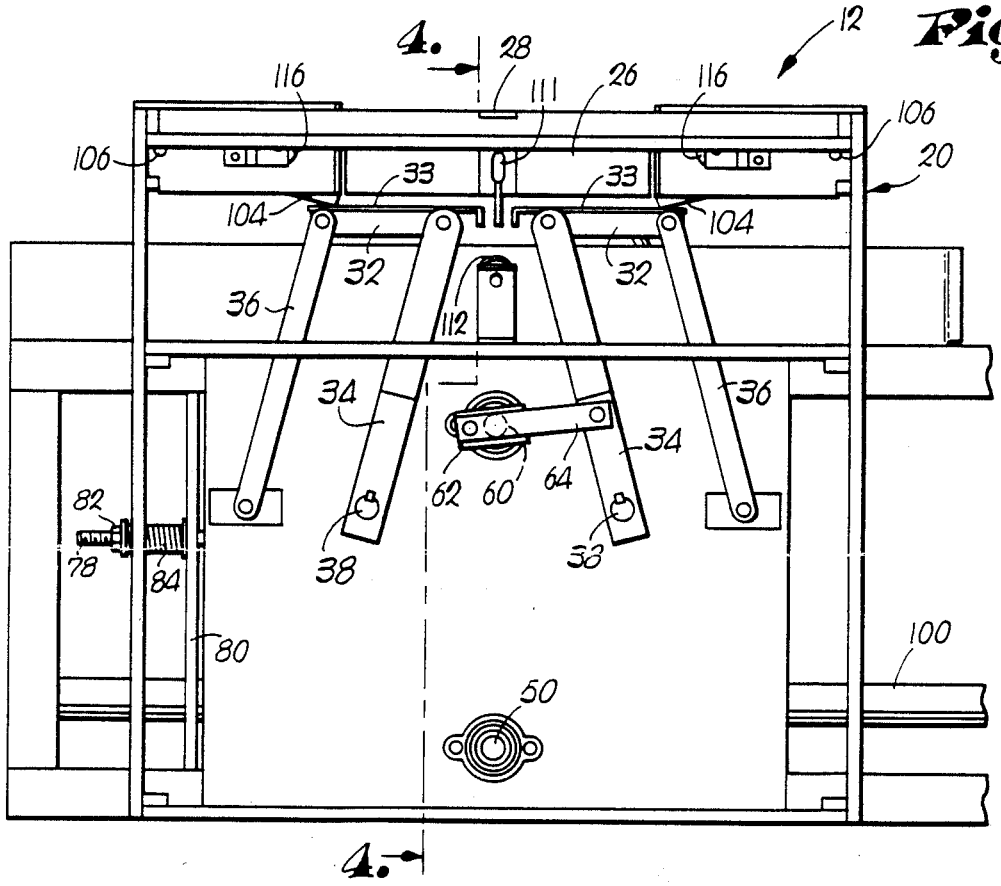
FIG. 3 is an enlarged, fragmentary, side elevational view of the hopper shown in FIG. 2, depicting a pair of shiftable, metering doors which are mounted on swingable links.
Figure 5:
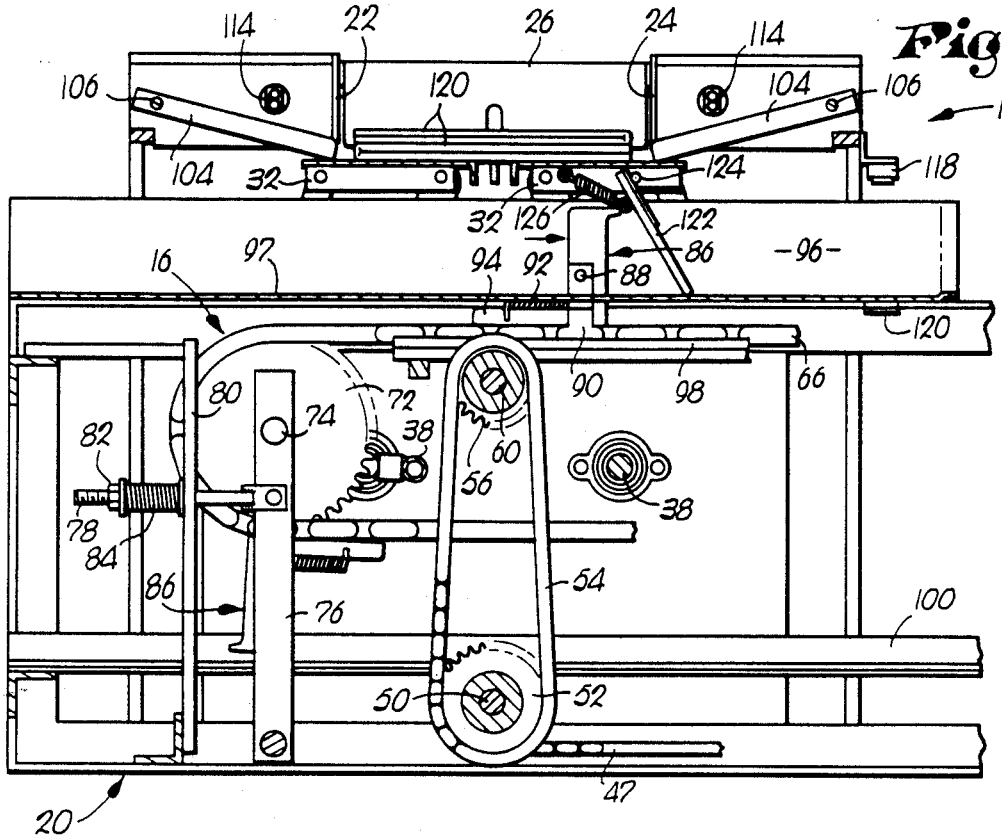
FIG. 5 is a fragmentary, side cross sectional view taken substantially along line 5—5 of FIG. 4, showing two newspaper sections which have been loaded onto the doors.
Figure 6:
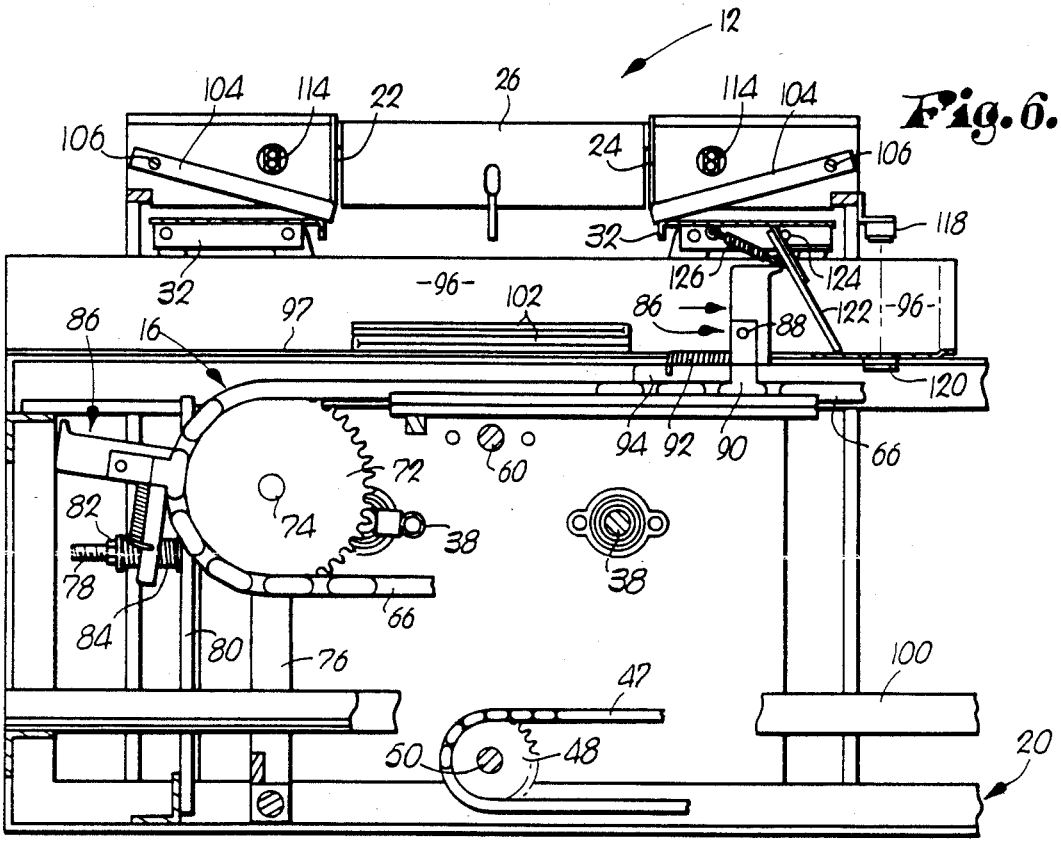
FIG. 6 is a fragmentary, side cross sectional view taken substantially along line 6—6 of FIG. 4, depicting the newspaper sections shown in FIG. 5 which have been dropped onto a table of the conveyor as a result of opening of the doors.

A gate means includes a pair of doors 32, 32 which are shiftable between a closed position that is shown in FIG. 5 and open position which is shown in FIG. 6. The doors 32 each have a flat, smooth, upwardly facing surface 33 (FIGS. 2 and 3), and each side of the doors 32 is pivotally mounted to upper ends of links 34, 36 (FIG. 3). A lower end of the upright link 36 is freely, pivotally connected to a block that is coupled to the frame 20, while the lower end of each link 34 is keyed to a shaft 38 (see also FIG. 4) that extends to the other side of the hopper 12 for fixed connection with a lower end of a similar link 34 supporting the opposite side of the respective door 32.

A drive for opening and closing the doors 32 includes a motor 40 (FIG. 1) which is connected to a roller chain 42 trained about a sprocket 44. In turn, sprocket 44 drives another roller chain 46 that extends through bottom reaches of the hopper 14 to drive doors of the latter. Another chain 47 (FIGS. 4–6) is driven by chain 46 for opening and closing doors 32 of hopper 12. The roller chain 47 is trained about a sprocket 48 (FIG. 6) fixed to a shaft 50.

As shown in FIG. 5, a sprocket 52 coupled to shaft 50 drives a roller chain 54 which extends upwardly and is trained about a sprocket 56. An electrically operated clutch 58 (FIG. 4) is connected to sprocket 56 and, upon energization, drives a horizontal shaft 60 that extends across the width of hopper 12 therebelow. Each end of shaft 60 fixed to a short crank arm 62 (FIGS. 2–3) that, in turn, is pivotally coupled to one end of an elongated linkage member 64 which is also connected to a mid-region of one of the links 34.

Consequently, electrical energization of clutch 58 causes power transmitted from roller chain 54 to be instantly directed to shaft 60 for a period of time which consists of one-half of a revolution of the latter. As the shaft 60 turns, the linkage member 64 thereby forces the link 34 outwardly to quickly move the respective door 32 from the closed position shown in FIG. 5 to the open position which is shown in FIG. 6. The shafts 38 ensure that both links 34 of each door 32 are driven simultaneously. Furthermore, while FIG. 3 illustrates linkage member 64 and crank arm 62 for driving the link 34 connected to one of the doors 32, it is to be understood in this respect that a similar crank arm 62 and linkage member 64 (see FIG. 2) are connected to the opposite end of shaft 64 driving the remaining door 32.

The conveyor 16 includes a pair of roller chains 66, one of which can be observed by reference to FIGS. 1, 5 and 6. Both of the chains 66 are driven for simultaneous, coordinated movement by a drive chain 68 (FIG. 1) that is powered by motor 40. One end of each chain 66 is trained about a respective sprocket 70 (FIG. 1) driven by chain 68, while the opposite end of each chain 66 extends partially around a sprocket 72 (FIGS. 5 and 6) located ahead and beneath the first metering hopper 12. Shaft 38 has an offset or U-shaped middle portion which is provided to clear sprockets 72, 72.

Each of the sprockets 72 is pivotally mounted on a shaft 74 which is supported by an upright leg 76 swingably connected to frame 20. Take-up apparatus for the chains 66 includes a threaded rod 78 coupled to the leg 76 and extending through an aperture in an upright member 80 of the frame 20. A nut 82, threaded onto the rod 78, is tightened against the bias of a spring 84 for urging the upright leg 76 in a direction away from the sprocket 70 at the opposite end of chains 66 in order to preclude excessive slack in the latter.

Each chain 66 carries a spaced series of projections or pushers 86 that are each connected by means of a pivot 88 to a carrier 90 fixedly mounted on the corresponding chain 66. A spring 92 interconnecting a bottom portion of the pusher 86 beneath pivot 88 and an arm 94 affixed to the carrier 90 normally retains the pusher 86 in an outwardly extending direction perpendicular to the direction of travel of the chain 66 therebeneath. However, should the pusher 86 hit an obstruction, the pusher 86 swings about pivot 88 to a retracted position until such time as the obstacle has been cleared whereupon spring 92 turns the pusher 86 toward its normal orientation transverse to the underlying portion of chain 66.

A pusher 86 of each chain 66 is in alignment with a corresponding pusher 86 mounted on the other chain 66 in directions transverse to the path of travel of chains 66. Thus, each pair of pushers 86 defines a corresponding, upstream receptacle or bucket area which is indicated by the numeral 96 in FIGS. 5 and 6. As the pushers 86 move in upright orientation along a path of travel above the upper reach of respective chains 66, the pushers 86 extend through corresponding slots formed in a flat, smooth, horizontal table 97 shown in FIGS. 4, 5 and 6.

As illustrated in FIG. 4, a pair of horizontally extending channels 98 connected to chain 20 provides support for upper reaches of the corresponding chains 66. Optionally, a pair of flat, horizontal guards 100 may be installed for preventing pushers 96 carried by lower reaches of the chains 66 from coming into obstructive contact with portions of the frame 20 or other components. Normally, nuts 82 are tightened sufficiently to retain the chains 66 in taut condition and maintain the pushers 86 in spaced deposition relative to guards 100 as shown in FIG. 4.

Turning now to FIG. 5, the upper surface 33 of doors 32 when the latter are in their closed position are essentially co-planar and in contact with a lowermost face of a unit or pair of newspaper sections 102 in flat, horizontal orientation. The space between the front walls 22, as well as the space between rear walls 24, facilitates loading of the newspaper sections 102 into hopper 12 inasmuch as a hand grasping a trailing or leading edge portion of the newspaper section 102 is provided with clearance to follow the sections 102 in a downwardly directed, sweeping arcuate motion toward doors 32. Easy withdraw of the hand is then provided through the spaces between the walls 22 or 24 in an inclined direction without sudden change in motion.

As shown in FIGS. 2, 5 and 6, a pair of inclined wiping elements or ramps 104 extends upwardly in opposite directions away from a lower region of the metering hopper 12. A lower edge of each ramp 104 is in sliding contact with the upper surface 33 of a corresponding door 32, while an upper end of each ramp 104 is pivotally connected to a rod 106 that in turn is fixed to components of frame 20. Each ramp 104 thereby defines a lower edge of a trough or ramp-like area that extends through spaces between the walls 22 or 24 and in an upwardly direction away from the lower region of hopper 12.

A microcomputer 108 (FIG. 1) is electrically coupled to the clutch 58 for opening the doors 32 in timed, coordinated relationship to the movement of the conveyor 16. As the doors 32 open, the lower edge of the wiping elements or ramps 104 slide along the upper surface of the doors 32 and thereby substantially preclude significant movement of newspaper sections 102 in a horizontal direction along with doors 32. The ramps 104 push, if necessary, against the sections 102 and cause the latter to drop to the bucket area 96 of the conveyors 16 therebelow as illustrated in FIG. 6. Moreover, the rod 106 pivotally mounting ramp 104 enables the latter to remain in contact with door 32 during opening and closing thereof even though door 32 moves through a slight arc as determined by the swinging motion of the supporting links 34, 36.

The apparatus 10 includes a number of sensing devices for ensuring proper operation. As shown in FIG. 4, a light source and sensor 110 positioned outside one of the sidewalls 26 cooperate with a reflector 112 disposed on the opposite side of hopper 12. Source 110 directs a beam of light through a hole 111 (FIG. 3) in the sidewall 26, through the space between the doors 32, toward the reflector 112 and then in an opposite direction back toward the sensor 110 in order to detect the presence of any newspaper sections 102 lying on top of doors 32.

As shown in FIGS. 2, 5 and 6, a source and sensor 114 are located above each of the ramps 104 fore and aft of hopper 12. The sources 114, situated behind sidewalls adjacent ramps 104, cooperate with respective reflectors 116 (FIG. 2) disposed behind sidewalls on the opposite side of ramps 104 for directing beams of light in a horizontal direction above ramps 104 toward reflectors 116 and back to the sensors 114 in order to sense the presence of a hand moving along the corresponding ramps 104.

As depicted in FIGS. 5 and 6, a source and sensor 118 located downstream of hopper 12 are positioned directly above a reflector 120 located immediately below a suitable opening formed in the conveyor table 91. The source 118 is operable to emit a vertical beam of light toward the reflector 120 in order to sense the presence of newspaper sections 102 moving along the conveyor 16, for purposes which will be explained hereinafter.

Referring to FIGS. 2 and 4, a light source 130 is mounted behind each of the rear walls 24 and directs a beam of light toward a respective sensor 132 supported immediately behind a corresponding front wall 22. The source 130 and sensor 132 are horizontally adjacent an upper region of the metering hopper 12 in order to sense the presense of loose papers or entire newspaper sections 102 that have become caught on the walls 22, 24, 26 of the hopper 12. That is, if all of the papers comprising the sections 102 do not lie in flat, horizontal configuration parallel to the upper surface 33 of the doors 32 and instead engage upper regions of the walls 22, 24, 26 as may occur when the operator does not correctly load the paper or when sections or inserts of the paper have become dislodged, the beam of light from source 130 is interrupted and the sensor 132 transmits a corresponding signal to microcomputer 108 which, in turn, prevents doors 32 from opening until such time as the problem has been corrected and the sections 102 are placed in flat, horizontal configuration.

A pair of special control fingers 122 (FIGS. 4–6) are connected by means of respective pivots 124 to the underside of the downstream door 32 relative to the path of travel of the upper reach of conveyor 16. The fingers 122 extend downwardly in a forwardly inclined direction toward the downstream metering hopper 14, and are yieldably biased toward the position shown in FIGS. 4–6 by means of respective springs 126. Thus, the fingers 122 move with the downstream door 32 during opening and closing thereof, yet may be swung about pivots 124 in a counterclockwise direction viewing FIG. 5 by overcoming the yieldable resistance of the springs 126.

The fingers 122 play a significant and important role in maintaining the desired high degree of control and stability over newspapers being handled by the drop hopper. In this respect, they serve the two-fold functions of acting as both "shock absorbers" for the newspapers after they have been impacted by the onrushing pusher 86 and "sizing means" or "squaring up" means for the newspapers at the instant they drop from the hopper onto the conveyor and tend to become disheveled.

As the newspaper sections 102 drop onto table 97, the doors 32 start to close and the pusher 86 comes into contact with the rear edge of the sections 102. The timing is such that, depending upon the thickness of the newspaper sections 102, the pusher 86 and the fingers 122 engage opposite sides of the group of sections 102 at about the same time, although in some instances the fingers 122 will engage the papers slightly later than the pusher 86. This essentially simultaneous engagement of the paper from opposite edges is important since the pusher 86 is necessarily traveling at relatively high speed and sharply impacts the rear edge of the stationary newspapers which have dropped into the path of travel of the pusher 86 and await its arrival. Without the presence of the fingers 122 at the "front end" of the newspapers, such impacting engagement would tend to jar the slick inserts and other materials out of the front of the newspaper and cause handling difficulties at downstream locations. The spring loaded, shock absorbing presence of the fingers 122 is very helpful in this respect.

Furthermore, it is always possible that the newspapers may tend to become somewhat disheveled out of a rectangular configuration as they drop onto the table 97 and are impacted by the pusher 86. Once again, the fingers 122 help to prevent such disorientation and to correct it in the event any should happen to occur.

At the same time, however, the springs 126 of fingers 122 are sufficiently weak that although they provide the desired shock absorbing and sizing functions above described, they can be overridden as the newspaper is pushed on down the line by the pusher 86, permitting the fingers 122 to swing upwardly in a counterclockwise direction about pivots 124 to the extent necessary to allow passage of the newspapers.

The metering hopper 14 is substantially identical to metering hopper 12 although both of the hoppers 12, 14 overlie the same conveyor 16. Thus, hopper 14 includes upright walls, ramps, shiftable doors, drive mechanism for the doors, and sensors as illustrated in FIGS. 7 and 8 corresponding to like numbered components described above with reference to metering hopper 12.

Preferably, the downstream hopper 14 of apparatus 10 includes two pairs of flap members 136, 138 which extend along a portion of the length of conveyor 16 beneath the metering hopper 14. Each flap member 136, 138 comprises a strip of flexible material such as nylon which readily self-deforms as the sections 102 are advanced along the table 97 therebelow.

Figure 7:
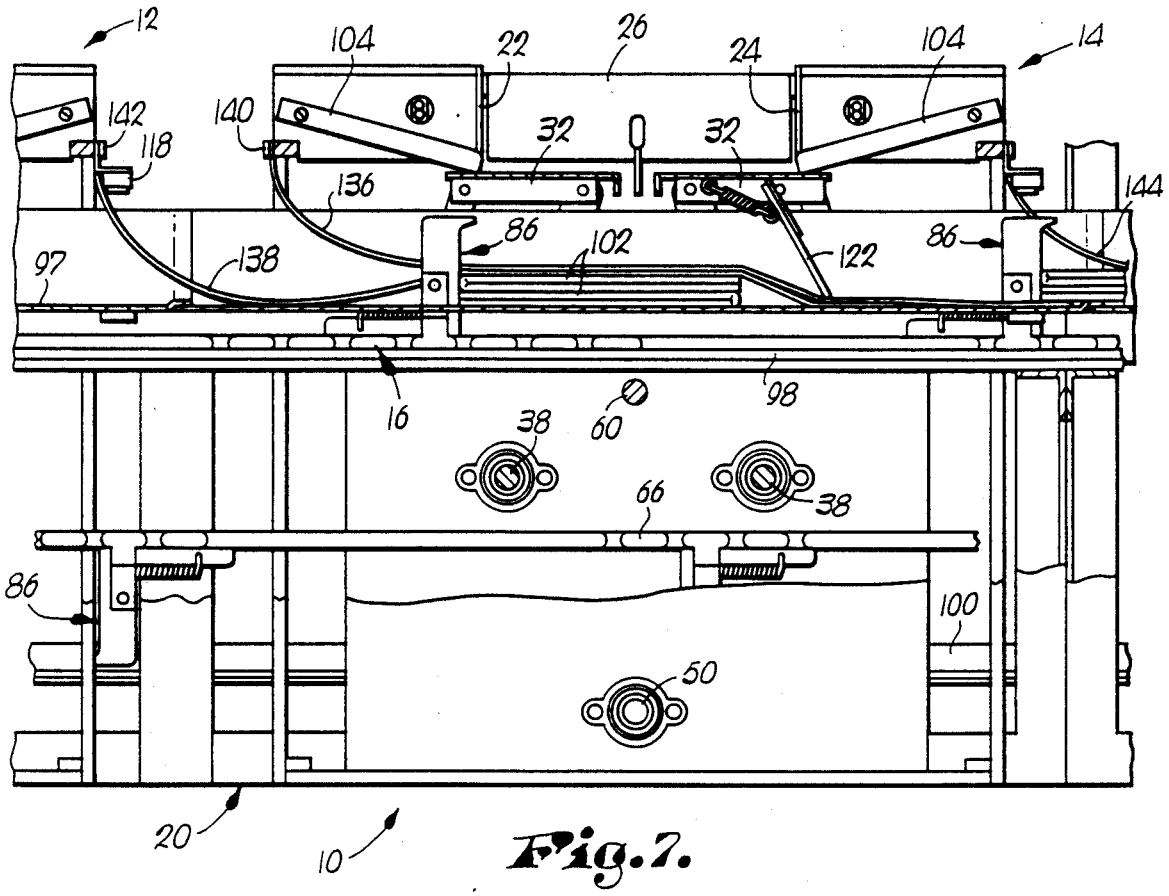
FIG. 7 is an enlarged, fragmentary, side elevational view of a preferred embodiment of the invention, illustrating the downstream metering hopper.
Figure 8:
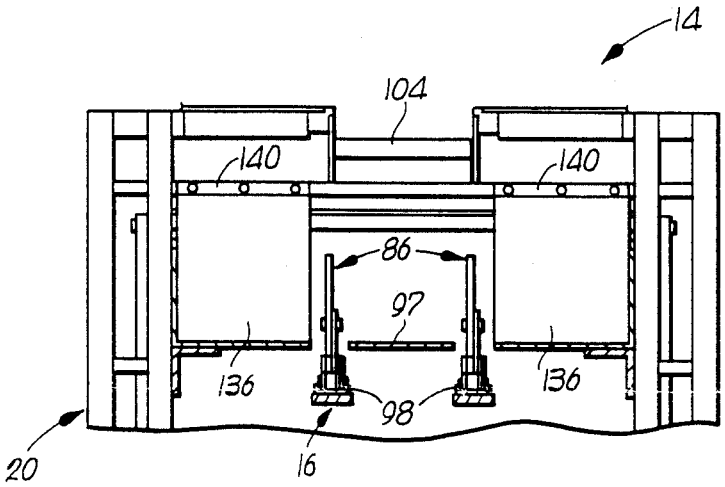
FIG. 8 is an enlarged, fragementary, end cross sectional view of the hopper shown in FIG. 7 looking in a direction toward the exit conveyor with the newspaper sections removed.

A leading edge of the first flap member 136 is secured to the frame of the hopper 14 by means of a plate 140 that can be observed in both FIGS. 7 and 8. On the other hand, a leading edge of the flap member 138 is secured to the frame 20 of hopper 12 by means of a plate 142 as shown in FIG. 7.

The flap members 136, 138 are particularly useful for retaining the individual papers of sections 102, and particularly the uppermost papers thereof, in flat orientation parallel with table 97. In this regard, it has somewhat been observed, particularly at higher conveyor speeds, that the leading corners of the uppermost pages of sections 102 may tend to fly up and bend rearwardly relative to the direction of advancement of conveyor 16. In some instances, the fingers 122 of the upstream hopper 12 contribute to this problem by wiping back the leading edges of the uppermost papers.

The flexible flap members 136, 138 readily conform to the configuration and height of the newspaper sections 102 passing therebelow and offer substantially no resistance to forward movement thereof.

The flap members 136, 138 also function to provide a landing area for newspaper sections dropping from the overlying hopper 14. In this regard, the drop speed is somewhat difficult to estimate in advance inasmuch as the speed with vary in accordance with the weight of the sections. When the apparatus 10 is used for collation purposes, the flap members 136, 138 tend to smooth over the effects of variations in drop velocity since the sections land on top of the flap member 136 and can easily be aligned with the pushers 86 by means of fingers 122 by sliding across the upper surface of flap member 136. As shown in FIG. 8, the members 136, 138 are disposed on opposite sides of the path of travel of pushers 86.

FIG. 7 also depicts a third flap member 144 located downstream of the hopper 14 for further facilitating the conveyance of the newspaper sections 102 along the conveyor 16 while keeping the papers of the sections 102 in assembled, flat form. The sections 102 beneath the flap members 136, 138 join with any sections sliding above flap member 136 at a location downstream of the trailing end of flap member 136. Thereafter the flap member 144 engages the top surface of the uppermost section.

Operation

Switches associated with the microcomputer 108 are pre-set by the workers before using the apparatus 10 in accordance with the desired mode of operation of the latter. The apparatus 10 is primarily useful for metering assembled newspaper sections in regulated fashion onto conveyor 16 toward downstream processing apparatus such as a bagger or an inserter; alternately, the switches associated with the microcomputer 108 may be set to enable the apparatus 10 to be utilized as a collator in addition to performing a conveying and metering function.

For example, smaller, weekday newspaper editions of only two to four sections may be completely assembled by each worker, and in this case the switches associated with the microcomputer 108 are set to ensure that each bucket area 96 receives only a single, assembled unit of newspaper sections 102 When only one individual is using apparatus 10 and the switches are switched accordingly, doors 32 remain closed until such time as: (1) sensor 110 has detected the presence of sections 102 atop doors 32; (2) the operator's hand has moved along ramp 104 and tripped the beam of light from source 114; (3) the next approaching bucket area 96 is in the proper disposition relative to hopper 12; and (4) sensors 132 fail to detect the existance of crooked or dislodged papers lying against the upright walls 22, 24, 26 of hopper 12. In this regard, a sensor 128 (FIG. 4) associated with shaft 50 is electrically coupled to the microcomputer 108 to enable the latter to determine the relative position of the bucket areas 96 along their path of travel as determined by roller chains 66.

As explained previously, once the newspaper sections 102 have dropped onto the table 91, the doors 32 close and the pushers 86 engage a rear edge portion of the sections 102. Shortly thereafter, or optionally at the same time, fingers 122 contact the leading edge of sections 102 to prevent loose, sliding motion of any of the sections or inserts thereof relative to the remaining sections 102 in contact with the pushers 86. As the pushers 86 continue to move along with the movement of chain 66, however, the fingers 122 deflect upwardly against the bias of spring 126 for passage of the sections 102 to the exit conveyor 18 and toward downstream processing apparatus.

As an alternative to the previous example, two or more individuals may simultaneously use the apparatus 10 in order to increase the number of assembled newspaper sections 102 per minute reaching the downstream handling equipment. For instance, for two-man operation, one person may be stationed at hopper 12 and the other person positioned adjacent 14. In this case, the microcomputer 108 would utilize the information received from the sensor 118 to determine the presence of an empty bucket area 96 approaching the downstream metering hopper 14 so that doors of the downstream hopper 14 do not open and drop newspaper sections 102 onto a unit of sections received in the same bucket area 96 from metering hopper 12. Normally, if the hoppers 12, 14 are loaded at the proper times, the doors of each hopper 12, 14 open alternately in sequence so that every other bucket area 96 receives a unit of newspaper sections 102 from the same metering hopper.

As other options, two workers may be stationed at one or both of the hoppers 12, 14. In these instances, the switches associated with the microcomputer 108 are again set accordingly and doors 32 open whenever sensor 110 detects the presence of a unit of newspaper sections 102 lying above the doors 32 and the beam of light associated with either of the sources 114 is interrupted due to the movement of a hand along one of the ramps 104. In the preferred mode of operation, the workers stationed at each hopper 12 or 14 take turns in loading a unit of newspaper sections 102 on doors 32. Again, in this mode, the doors of the downstream metering hopper 14 do not open for a particular bucket area unless the sensor 118 first determines that such bucket area is empty.

Apparatus 10 is particularly useful for assembly and collating larger newspaper editions such as Sunday editions which are comprised of more than four sections. In this regard, time studies have shown that newspaper collation by a group of individuals is most efficient when each person handles a maximum of three or four sections.

If, for instance, two individuals are deployed for each handling three different sections of a six section edition, one individual stationed at the metering hopper 12 places three newspaper sections 102 on the doors 32 which then open (after sensors 110, 114 are tripped) at a precise time as determined by the microcomputer 108 to drop sections 102 toward an empty bucket area 96 therebelow. Next, the doors of the downstream metering hopper 14 open to drop the three remaining sections 102 onto flap members 136, 138 above the previously received sections 102 in the bucket area 96, so that the newspaper edition is complete. In this instance, the doors of the downstream hopper 14 do not open to load a particular bucket area unless the sensor 118 has first determined that the particular bucket area has indeed received sections from the upstream hopper 12.

For four-man operation wherein each individual contributes different, respective sections of newspaper to an assembled edition, the microcomputer 108 retains doors 32 in their closed position until such time as both of the sensors 114, 114 have detected motion of hands along their corresponding ramps 104. Once motion is detected by both sensors 114, 114 the doors 32 open to drop the sections from the metering hopper 12 and the pushers 86 advance the unit toward the downstream metering hopper 14 where other sections of the edition are awaiting. Thus, if sensor 118 detects the presence of a partially assembled newspaper unit advancing along the conveyor 16, the doors of the downstream metering hopper 14 open to drop the remaining sections on top of flap members 136, 138 the previously received sections (assuming the sensors of hopper 14 corresponding to sensors 110, 114 are first tripped). The assembled paper is then advanced toward the exit conveyor 18 to downstream processing apparatus.

A number of important safety features are also associated with apparatus 10. As shown in FIG. 4, an overload clutch 134 operably interconnects shaft 50 and roller chain 54 to shut down the apparatus 10 whenever clutch 134 senses that the mechanism downstream from chain 54 has jammed. For example, if the operator's hand prevent the doors 32 from closing, or the doors 32 cannot open for some reason, the clutch 134 opens and operates a switch to interrupt the flow of current to the entire apparatus 10.

In addition, the pivotal mounting of the pushers 86 enable the latter to deflect in a rearwardly direction when encountering an obstacle including a hand or the like. Moreover, an overhead rope interconnected with a power switch for the apparatus 10 may be provided so that the users can reach up and shut down the apparatus 10 in the case of an emergency.

In practice, the configuration of the hopper 12 has been found to be extremely helpful for permitting helpful, fast operation of the apparatus 10. In this respect, it is to be noted that the trough-like areas immediately above respective ramps 104 enable the operator's hands to readily lower the newspaper sections 102 toward the doors 32 even though the walls 22, 24, 26 are only slightly larger than the perimeter of the newspaper sections 102. Moreover, the areas above ramps 104 enable the hands to be withdrawn after placement of the sections 102 therein with an arc-like, sweeping motion that is smooth and continuous and does not demand sudden changes in direction as might occur, for example, if the boundaries of the hopper were strictly defined by upright sidewalls. The source and sensors 114 above each ramp 104 conveniently provide a signal to the microcomputer 108 which infers that newspaper sections 102 are thereby in place against the doors 32 without the need for the operator to press switches or effect movements other than simply drawing his or her hand away from the loaded newspaper sections 102.

Advantageously, the metering hoppers 12, 14 enable the users to simply load the newspaper sections 102, and, after withdrawing their hands along the ramps 104, immediately turn and begin picking up other sections for the subsequent loading cycle. As a consequence, the users need not match their movements with the relative positions of the approaching bucket areas 96, inasmuch as the microcomputer 108 opens the doors 32 at the proper time. Furthermore, the papers cannot be incorrectly assembled since the doors 32 will not open unless an empty bucket is sensed, or in the case of newspaper collation, unless newspaper sections are detected in the next bucket area 96 approaching the downstream hopper 14.

I claim:

1. Newspaper section handling apparatus comprising:

means defining an upright hopper for receiving at least one newspaper section in generally flat and substantially horizontal orientation, said hopper presenting a lower discharge outlet located in the bottom thereof, said at least one newspaper section presenting a lowermost face;

means defining a conveyor for moving newspaper sections along a path of travel including a portion extending beneath said hopper;

means defining a gate for said discharge outlet;

means for shifting said gate means between a closed position closing said outlet and an open position opening said outlet, said gate means including means engageable with said lowermost face of said at least one newspaper section for supporting the latter in said hopper when said gate means is in said closed position, said gate means when in said open position enabling newspaper sections received in said hopper to drop through said outlet and onto said conveyor;

means for selectively actuating said shifting means in order to shift said gate means toward said open position in timed relationship to the movement of said conveyor means, said means engageable with said lowermost face including a smooth upwardly facing surface slidably engageable with said lowermost face of said newspaper section during said shifting movement of said gate means; and a wiper element in sliding contact with said upwardly facing surface of said gate means during movement between said closed position and said open position for facilitating sliding motion of said upper surface relative to any newspaper sections supported thereon.

2. The invention as set forth in claim 1, wherein said wiper element is mounted for pivotal movement about a generally horizontal axis in disposition for resting contact with said surface of said gate means.

3. The invention as set forth in claim 1, wherein said gate means comprises a pair of doors shiftable in respective, generally horizontal directions toward and away from each other.

4. The invention as set forth in claim 3, wherein said doors are pivotally mounted on respective upright, elongated links swingable about corresponding, generally horizontal axes.

5. The invention as set forth in claim 1; and including a pair of flexible members extending beneath said lower discharge outlet of said hopper.

6. Newspaper section handling apparatus comprising:

means defining an upright hopper for receiving at least one newspaper section in generally flat and substantially horizontal orientation, said hopper presenting a lower discharge outlet located in the bottom thereof, said at least one newspaper section presenting a lowermost face;

means defining a conveyor for moving newspaper sections along a path of travel including a portion extending beneath said hopper;

means defining a gate for said discharge outlet;

means for shifting said gate means between a closed position closing said outlet and an open position opening said outlet, said gate means including means engageable with said lowermost face of said at least one newspaper section for supporting the latter in said hopper when said gate means is in said closed position, said gate means when in said open position enabling newspaper sections received in said hopper to drop through said outlet and onto said conveyor;

means for selectively actuating said shifting means in order to shift said gate means toward said open position in timed relationship to the movement of said conveyor means, said means engageable with said lowermost face including a smooth upwardly facing surface slidably engageable with said lowermost face of said newspaper section during said shifting movement of said gate means, said conveyor means including a plurality of spaced-apart, pre-defined receptacle areas sequentially presented to a region beneath said hopper means during movement of said conveyor means; and means for sensing the presence of any newspaper sections within each of said areas as the latter move toward said region beneath said hopper means.

7. The invention as set forth in claim 6; and including means for preventing shifting movement of said gate means during occasions when newspaper section received in said hopper means fail to lie substantially flat orientation in resting contact with said gate means.

8. The invention as set forth in claim 6; and including means for sensing the presence of newspaper sections within said hopper means.

9. The invention as set forth in claim 6, wherein said conveyor means includes an endless chain carrying a spaced series of normally upstanding projections which define said receptacle areas.

10. THe invention as set forth in claim 9, wherein said projections are pivotally coupled to said chain for swinging movement in a direction generally opposite to the path of travel of said chain.

11. The invention as set forth in claim 10, wherein said conveyor means further includes means yieldably biasing said projections in a direction forwardly relative to the path of travel of said chain.

12. Newspaper section handling apparatus comprising:

means defining an upright hopper for receiving at least one newspaper section in generally flat and substantially horizontal orientation, said hopper presenting a lower discharge outlet located in the bottom thereof, said at least one newspaper section presenting a lowermost face;

means defining a conveyor for moving newspaper sections along a path of travel including a portion extending beneath said hopper;

means defining a gate for said discharge outlet;

means for shifting said gate means between a closed position closing said outlet and an open position opening said outlet, said gate means including means engageable with said lowermost face of said at least one newspaper section for supporting the latter in said hopper when said gate means is in said closed position, said gate means when in said open position enabling newspaper sections received in said hopper to drop through said outlet and onto said conveyor; and means for selectively actuating said shifting means in order to shift said gate means toward said open position in timed relationship to the movement of said conveyor means, said conveyor means including an endless chain carrying a spaced series of normally upstanding projections which define corresponding, pre-defined upstream areas of said conveyor means for receiving newspaper sections from said hopper means, said gate means including a gate movable in a direction opposite to that of the projection of the conveyor means while the gate means is closing following discharge of a newspaper section from the hopper, said gate having a finger depending therefrom and disposed in the path of travel of the newspaper section as it moves with the conveying means for cooperating with the corresponding projection of the conveying means in substantially simultaneously contacting opposite leading and trailing edges of the newspaper section to absorb shock loads and prevent disorientation of the newspaper section.

13. The invention as set forth in claim 12, wherein said finger is pivotally mounted to said gate and is provided with means yieldably biasing the finger in a direction generally opposite to the direction of movement of the conveyor means, said yieldable biasing means being operable to permit said finger to swing upwardly under the urging of a newspaper section being moved by said conveying means to a position permitting passage of the moving section beneath said finger.

14. A method of conveying newspapers comprising the steps of:

loading onto a bottom gate of an upright hopper at least one newspaper section in substantially flat, generally horizontal disposition;

advancing a conveyor along a path of travel including a portion extending beneath said hopper;

opening said bottom gate of said hopper to release any newspaper sections therein for movement in a substantially vertical direction toward said conveyor; and wiping an upper surface of said gate during opening thereof in order to facilitate release of said newspaper sections from said hopper.

15. The method as set forth in claim 14, wherein said step of loading at least one newspaper section into said hopper includes the step of flatly contacting a lower face of said at least one newspaper section with an upper surface of said gate.

16. The method as set forth in claim 14, wherein said step of opening said gate is carried out in timed relationship with the movement of said conveyor in order to drop newspaper sections at predefined, spaced apart locations of said conveyor.

17. Newspaper conveying apparatus comprising:

means defining an upright hopper having a lower region;

means defining a gate movable toward a position extending across said lower region of said hopper means and toward a position away from said lower region of said hopper means, said gate means being of a configuration for supporting at least one newspaper section in a generally flat orientation;

means defining a ramp extending from said lower region of said hopper means and away therefrom in an upwardly, inclined direction; and means for sensing the presence of a hand moving along said ramp in order to thereby infer the loading of at least one newspaper section on said gate means.

18. The invention as set forth in claim 17, wherein said means defining said ramp comprises an element slidably engageable with said gate means during movement thereof.

19. The invention as set forth in claim 17, wherein said means for determining the presence of a hand moving along said ramp means comprises a photoelectric source and a sensor arranged to detect a beam of light emitting from said source and traveling in a direction across and above said ramp means.

20. A method of conveying newspapers comprising the steps of:

loading by hand at least one newspaper section in generally flat disposition onto a bottom door of an upright hopper;

moving the hand loading said papers away from said bottom door and along a path of travel to trip a sensor; and shifting said bottom door to drop said at least one newspaper section from said hopper once said sensor has been tripped.

21. A method of metering the delivery of newspaper sections to a conveyor comprising the steps of:

loading by hand at least one newspaper section in generally flat disposition onto a bottom gate of an upright hopper;

advancing a conveyor having a number of sequentially disposed receptacle areas toward a region beneath the hopper;

sensing with a first sensor the condition of each receptacle area as the latter approach the region beneath said hopper to determine whether or not each of the approaching receptacle areas has previously received at least one newspaper section;

transmitting a signal from said first sensor to a microcomputer;

detecting the movement of the conveyor with a second sensor electrically interconnected with said microcomputer; and opening said bottom gate of said hopper by means of said microcomputer in timed relationship to the movement of said conveyor as detected by said second sensor in accordance with whether or not said first sensor has sensed the presence of at least one newspaper section within the approaching receptacle area of said conveyor.

22. In a bottom discharging hopper for dropping newspaper sections by gravity toward means for receiving the discharged newspaper sections, the improvement comprising:

a pair of side-by-side doors extending across the bottom of the hopper in a common, generally horizontal plane for supporting newspaper sections loaded into the hopper;

a pair of generally upright, parallel operating links for each of said doors respectively, said links being disposed below the doors, and each pair having upper ends pivotally coupled with a corresponding door; and drive means operably coupled with said links for oscillating the two pairs generally toward and away from one another upon actuation of the drive means whereby to correspondingly open and close said doors, said doors remaining generally flatly disposed within said common horizontal plane as they move toward and away from one another during opening and closing of the hopper bottom and as the plane of the doors is shifted a short distance upwardly and downwardly during oscillation of the links whereby to efficiently release newspaper sections from the hopper to said receiving means.

23. In a bottom discharging hopper as claimed in claim 22, said receiving means for the discharged newspaper sections comprising a continuously moving conveyor having a path of travel lying in a plane which is substantially parallel with the common plane of said doors, said hopper having structure defining clearance openings through which said conveyor may pass during movement along said path of travel.

24. Newspaper handling apparatus comprising:

an upright hopper having a discharge outlet at the bottom thereof and a gate for opening and closing said outlet, said gate being disposed to support a supply of newspaper sections in the hopper when the gate is closed and to drop the supply of sections from the hopper when the gate is open;

a conveyor continuously movable along a path of travel extending beneath said hopper in disposition for receiving successive supplies of the newspaper sections form the hopper during successive openings of the gate, said conveyor having a series of predetermined receiving areas thereon which are spaced apart in the direction of conveyor travel;

operating means for opening and closing said gate in timed relationship to arrival of the receiving areas of the conveyor beneath the hopper; and means for sensing the condition of the receiving areas of the conveyor as they sequentially move into position beneath the hopper, said sensing means being operably coupled with said operating means of the gate for opening the gate and discharging successive supplies of the newspaper sections into corresponding empty receiving areas of the conveyor as said empty areas are detected by the sensing means.

* * * * *